US006954997B2

(12) United States Patent
Meibock

(10) Patent No.: US 6,954,997 B2
(45) Date of Patent: Oct. 18, 2005

(54) APPARATUS, SYSTEM, AND METHOD FOR ENGAGING TOES IN FOOTWEAR

(75) Inventor: Antonin A. Meibock, Calgary (CA)

(73) Assignee: Kor Hockey Ltd., Calgary (CA)

( * ) Notice: Subject to any disclaimer, the term of this patent is extended or adjusted under 35 U.S.C. 154(b) by 0 days.

(21) Appl. No.: 10/729,855

(22) Filed: Dec. 5, 2003

(65) Prior Publication Data

US 2004/0159018 A1 Aug. 19, 2004

Related U.S. Application Data

(60) Provisional application No. 60/443,449, filed on Jan. 28, 2003.

(51) Int. Cl.[7] ..... A43B 7/14; A43B 23/08
(52) U.S. Cl. ..... 36/77 R; 36/96; 36/72 R; 36/94
(58) Field of Search ..... 36/77 R, 88, 94, 36/96, 117.6, 58.5, 72 R

(56) References Cited

U.S. PATENT DOCUMENTS

| | | | | |
|---|---|---|---|---|
| 1,349,095 | A * | 8/1920 | Parisi | 36/94 |
| 4,253,251 | A * | 3/1981 | Salomon | 36/117.9 |
| 4,509,276 | A | 4/1985 | Bourque | |
| 4,826,183 | A | 5/1989 | Bratland et al. | |
| 4,870,762 | A * | 10/1989 | Lee | 36/77 R |
| 5,007,184 | A * | 4/1991 | Lee | 36/77 R |
| 5,164,240 | A | 11/1992 | Burgess et al. | |
| 5,390,430 | A | 2/1995 | Fitchmun et al. | |
| 5,401,564 | A | 3/1995 | Lee et al. | |
| 5,909,946 | A | 6/1999 | Okajima | |
| 5,913,593 | A | 6/1999 | Aird et al. | |
| 5,940,991 | A | 8/1999 | Cabalquinto | |
| 5,974,697 | A * | 11/1999 | Tseng | 36/77 R |
| 6,073,370 | A | 6/2000 | Okajima | |
| 6,079,128 | A | 6/2000 | Hoshizaki et al. | |
| 6,119,372 | A | 9/2000 | Okajima | |
| 6,260,290 | B1 | 7/2001 | Chenervert | |
| 6,295,679 | B1 | 10/2001 | Chenervert | |
| 6,389,715 | B1 * | 5/2002 | Krajcir | 36/77 R |
| 6,412,195 | B1 * | 7/2002 | Mack et al. | 36/77 R |
| 6,499,233 | B1 | 12/2002 | Chenervert | |
| 6,505,422 | B2 | 1/2003 | Racine | |
| 6,581,304 | B2 * | 6/2003 | Mitchell | 36/77 R |
| 6,647,576 | B2 | 11/2003 | Racine | |
| 6,718,656 | B2 * | 4/2004 | Houser et al. | 36/88 |

FOREIGN PATENT DOCUMENTS

| | | |
|---|---|---|
| WO | PCT/EP98/03902 | 6/1998 |
| WO | WO 99/01047 | 1/1999 |

* cited by examiner

*Primary Examiner*—Anthony Stashick
(74) *Attorney, Agent, or Firm*—Black Lowe & Graham; Darren J. Jones

(57) ABSTRACT

Apparatuses, a system, and a method for engaging a wearer's toes within an interior of a footwear item are provided. A panel is configured to extend at least partially across a toebox of the interior of the footwear item. An attachment mechanism is configured to position the panel in the interior of the footwear item so that the panel is positioned inside the toebox to engage an edge of at least one of the wearer's toes. The panel includes a flexible or stretchable material such as neoprene. The attachment mechanism includes at least one of stitching, adhesive bonding, and thermal welding. The attachment mechanism joins the panel to the interior of the footwear item at a plurality of points along at least one of a lower edge of the panel and side edges of the panel, such as by joining the panel to an insole.

44 Claims, 2 Drawing Sheets

APPARATUS, SYSTEM, AND METHOD FOR ENGAGING TOES IN FOOTWEAR

PRIORITY CLAIM

This invention claims priority from U.S. Provisional Application No. 60/443,449, filed Jan. 28, 2003.

FIELD OF THE INVENTION

This invention relates generally to footwear and, more specifically, to interior lining of footwear.

BACKGROUND OF THE INVENTION

Over the past few decades, much more attention has been paid to ergonomics, kinesthetics, and other endeavors to tailor human environments to better suit people's bodies and how their bodies move. Such efforts are motivated by desires to make people more comfortable, reduce pain resulting from unnatural positions and movements, and, not the least of which, to improve performance.

One particular area in which tremendous investments and advances have been made in athletic footwear. Only a few decades ago, state-of-the-art basketball shoes had flat rubber bottoms and a flat, canvas high-topped upper. In that same time frame, few people had heard of, let alone owned, a pair of "running shoes." Certainly, no one had ever heard the term "cross-trainer." However, today the benefits of exercise are both better understood and better appreciated. Similarly, it is now understood how appropriate footwear not only can enhance athletic performance, improve foot comfort, and reduce foot pain, but it is also appreciated that appropriate footwear can prevent knee injuries, alleviate back pain, and yield countless other benefits.

Greater strides have been made with footwear with soft uppers. A shoe with a soft upper can stretch to conform to a wearer's foot to provide appropriate fit and support. A soft upper also facilitates "proprioception," which allows the wearer to take advantage of the unconscious perception of movement and spatial orientation gained from stimuli of the footwear appropriately contacting surfaces of the wearer's foot.

On the other hand, advances have not been made as rapidly in the case of more rigidly-shelled athletic wear such as ski boots and skates. Ski boots and skates tend to have semi-rigid or rigid outer shells to securely receive the feet and ankles of the wearer to better translate the wearer's movements to the wearer's skis and skates, respectively. Similarly, protective work boots may include semi-rigid or rigid uppers to protect a worker's feet, or at least may include a semi-rigid or rigid toebox to protect a worker's toes. In the case of hockey skates, a certain rigidity of the upper is desired to protect the foot of the wearer from contact injuries that may be inflicted by sticks, pucks, other players' skates, and other objects. Unlike soft-uppered footwear which can allow a degree of plasticity on the sides and in the toe to accommodate different dimensions of wearers' feet, footwear having a semi-rigid or rigid upper or toebox generally tends to accommodate a largest range of foot dimensions for a given size. Certainly, few could or would tolerate a ski boot or skate having a semi-rigid or rigid shell continually pressing against, for example, the front or top of his or her toes. Such a fit also could increase the potential exposure of the wearer to toe contact injuries. As a result, there tends to be some open space left around the sides and/or the toes of at least some wearers' feet in footwear having a semi-rigid or rigid upper or toebox.

FIG. 1 shows a conventional footwear item 100 having a semi-rigid or rigid upper 110 joined to a sole 120 being worn on a foot 130 and ankle 140 of a wearer. It is desired for comfort and control that a heel 150 of the foot 130 fits securely in a heel portion 160 of the footwear 100. By contrast, toes 170 of the wearer are accommodated loosely in a toebox 180 of the footwear 100. Loose fitting of the toebox 180 allows the wearer to move his or her toes to allow for movement, balance, and other control without pressing against the toes 170 of the wearer which could be uncomfortable or injurious to the wearer.

Such open space in such footwear may be unfortunate. Body heat can be lost to the open space, leaving the wearer cold and uncomfortable. Similarly, with the wearer's foot not engaging the inside of the footwear, synergistic benefits of the contact of the foot with the footwear is lost.

Thus, there is an unmet need in the art for footwear with semi-rigid or rigid uppers or toeboxes to engage the foot of the wearer to provide comfort and other sensate benefits.

SUMMARY OF THE INVENTION

Embodiments of the present invention provide a toe engaging mechanism for an interior of a footwear item. Particularly in conventional footwear having a semi-rigid or rigid upper or a semi-rigid or rigid toebox, a wearer's toes may be moved upward or forward without contacting the interior of the footwear item, causing the wearer to be unable to derive benefits from having his or her toes at least intermittently contacting the interior of the footwear item. For example, the wearer may lose sensory benefits from having his or her toes contact the interior of the footwear item or lose body heat to the open space surrounding his or her toes. Embodiments of the present invention allow at least some of the toes of the user to contact a panel movably disposed within the interior of the footwear. The panel allows toes of the user to contact an interior surface to retain sensory benefits and/or body heat without uncomfortably restricting the wearer's toes. At the same time, the wearer's toes are removed from an exterior surface of the toebox of the footwear item, protecting the toes from impact injuries that may result from an object striking an outside surface of the toebox. Also, while the wearer's toes contact the panel movably disposed within the interior of the footwear, an open space between the panel and the toebox provides for additionally breathability for the wearer's foot.

More particularly, the present invention provides apparatuses, a system, and a method for engaging a wearer's toes within an interior of a footwear item. A panel configured to extend at least partially across a toebox of the interior of the footwear item is provided. The panel is coupled to an interior of the footwear item such that the panel is positioned inside the toebox to engage an edge of at least one of the wearer's toes. The panel includes a flexible or stretchable material such as neoprene. The attachment mechanism includes at least one of stitching, adhesive bonding, and thermal welding. The attachment mechanism joins the panel to the interior of the footwear item at a plurality of points along at least one of a lower edge of the panel and side edges of the panel, such as by joining the panel to an insole.

Other embodiments of the present invention include a footwear liner equipped with a panel coupled with the lining using an attachment mechanism configured for engaging toes of a wearer. Alternatively, embodiments of the present invention include a footwear system having an upper in which toes of a wearer can be moved without generally contacting an interior of the upper, an outersole, and a panel coupled with an interior of the upper for engaging toes of a wearer. Further, a method of the present invention includes forming a panel, positioning the panel at a location inside the toebox to engage an edge of at least one of the wearer's toes, and securing the panel at the location.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, the present invention provides apparatuses, a system, and a method for engaging a wearer's toes within an interior of a footwear item. A panel configured to extend at least partially across a toebox of the interior of the footwear item is provided. The panel is coupled to an interior of the footwear item such that the panel is positioned inside the toebox to engage an edge of at least one of the wearer's toes.

Figure 1:
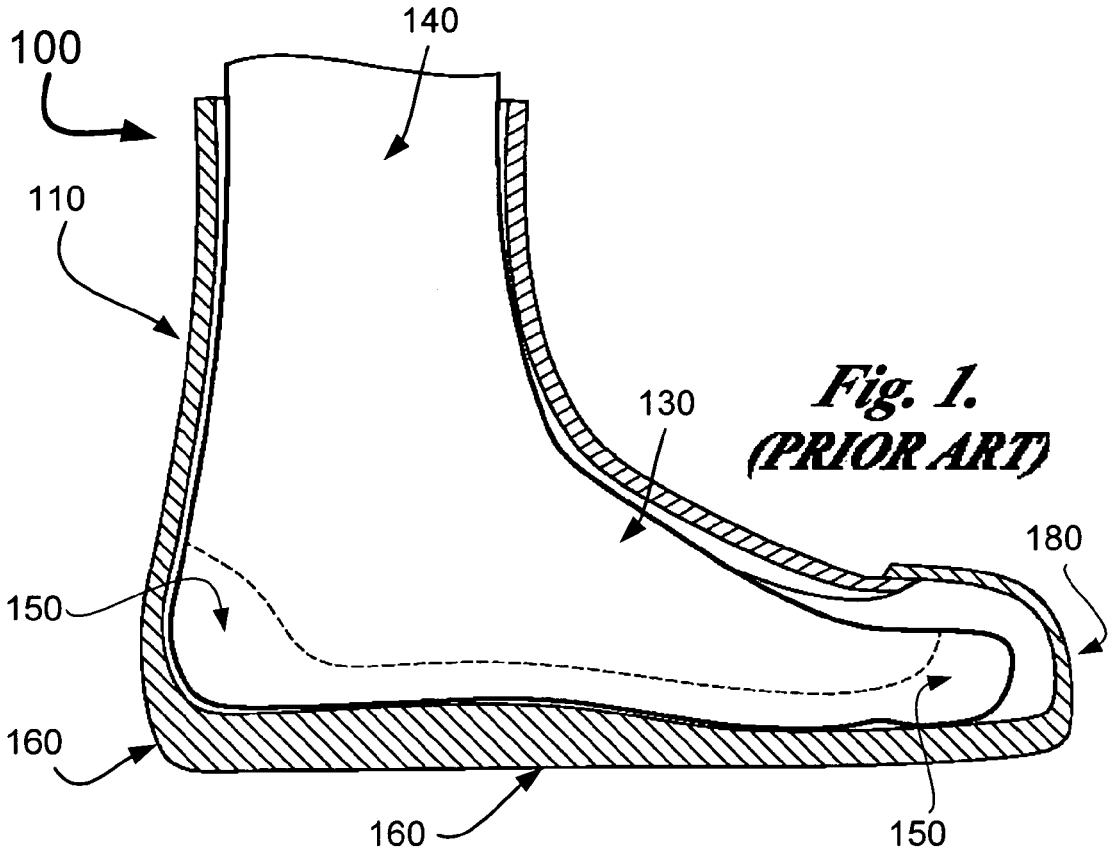
Fig. 1. (PRIOR ART)
FIG. 1 is a side cutaway view of a conventional footwear item worn by a user.
Figure 2:
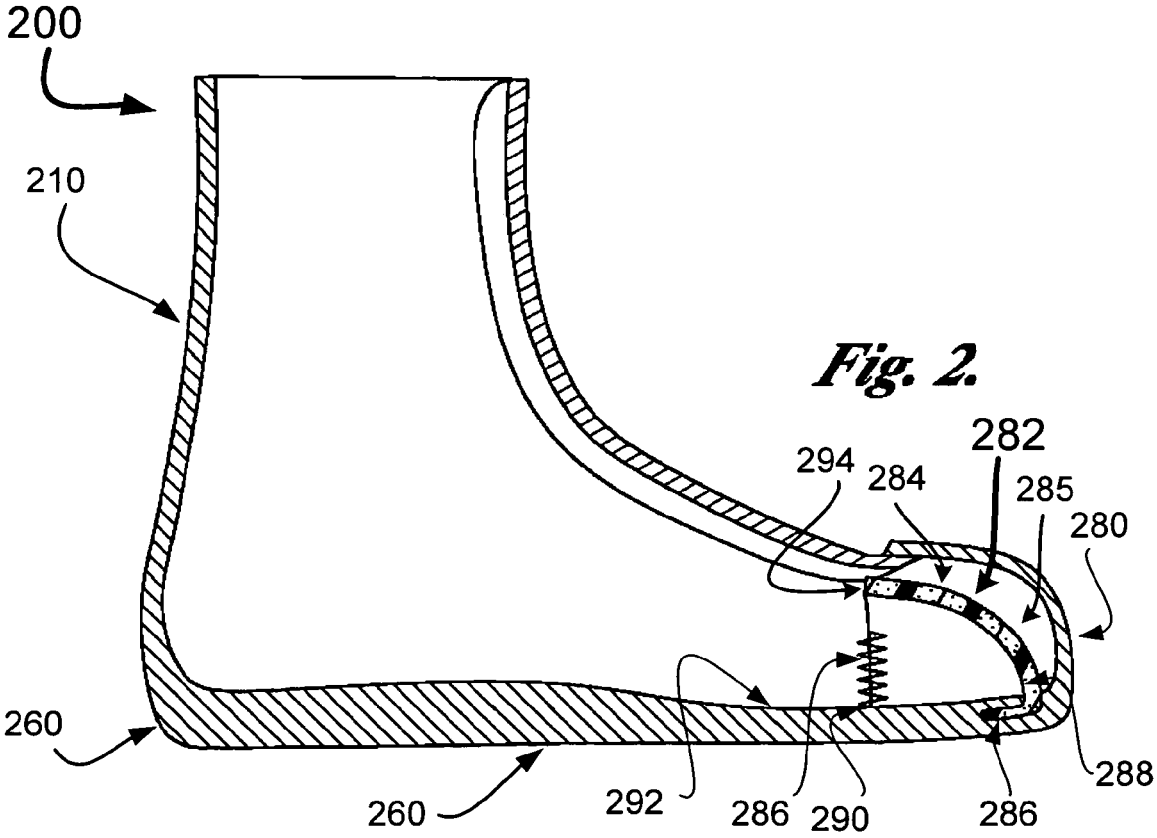
FIG. 2 is a side cutaway view of footwear including a toe engaging apparatus according to an embodiment of the present invention.

FIG. 2 shows a footwear item 200 according to an embodiment of the present invention. The exemplary footwear item 200 shown includes a rigid upper 210 joined to a sole 220. It will be appreciated that embodiments of the present invention are well-suited to be used with footwear having a semi-rigid or rigid upper or a semi-rigid or rigid toebox, although embodiments of the present invention suitably are used with other types of footwear as well. As in the case of many forms of conventional footwear 100 (FIG. 1), a toebox 280 is configured to loosely accommodate the toes (not shown) of the wearer to allow for movement of the toes and/or protection of the toes from impact forces applied against an outer surface of the toebox 280.

An embodiment of the present invention, however, includes a toe engaging apparatus 282 for alleviating or eliminating negative consequences from a wearer's toes not contacting an interior surface of the footwear 200. The toe engaging apparatus 282 includes a panel 284 configured to engage the toes (not shown). In preferred embodiments of the present invention, the panel 284 includes one of at least a flexible or a stretchable material. For example, the panel 284 is formed of neoprene or a similar elastic material. Use of a flexible or stretchable material presents a surface configured to engage one or more of a wearer's toes without compressing, constricting, or otherwise negatively applying force to the toes.

The panel 284 is flexibly coupled to an interior of the footwear 200 using at least one attachment mechanism 286. The attachment mechanism suitably includes at least one of stitching, adhesive bonding, and thermal welding for flexibly joining the panel 284 to an interior surface of the footwear 200. In one presently preferred embodiment, the panel 284 is joined to the interior surface of the footwear 200 by attachment mechanisms 286 along at least one of a lower edge of the panel 288 and side edges of the panel 290. For example, the panel 284 could be joined to an insole 292 disposed within the interior of the footwear with the panel coupled by the attachment means 286 to a lower surface and edges of the insole 292 to flexibly support the panel 284 within the interior of the footwear 200.

In one presently preferred embodiment, the panel 284 is not coupled to an upper surface 294 of the interior of the footwear 200. Attaching the panel 284 to an interior surface of the footwear 200 without attaching the panel 284 to an upper surface 294 of the interior of the footwear 200 enables the panel 284 to move more freely within the toebox 280 to allow the wearer's toes (not shown) to be flexibly engaged by the panel.

Figure 3A:
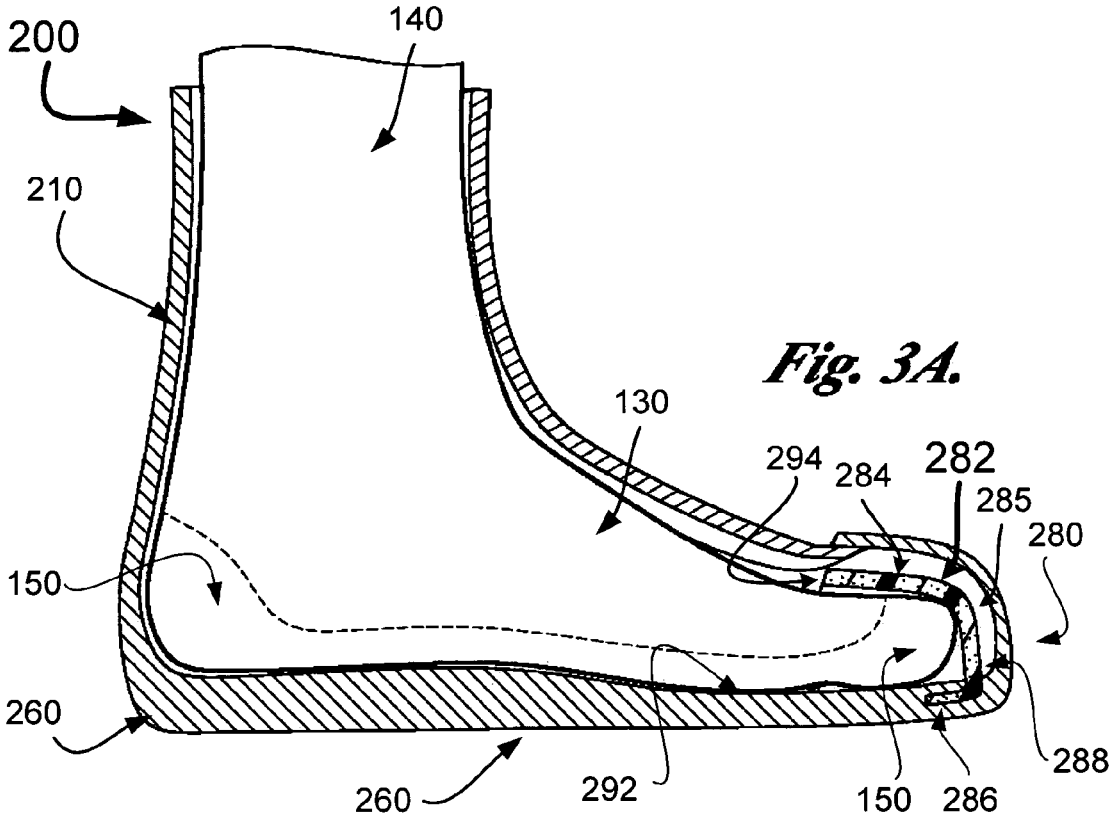
FIG. 3A is a side cutaway view of footwear including the toe engaging apparatus, the footwear being worn by a user with the user's toes in a lowered position.
Figure 3B:
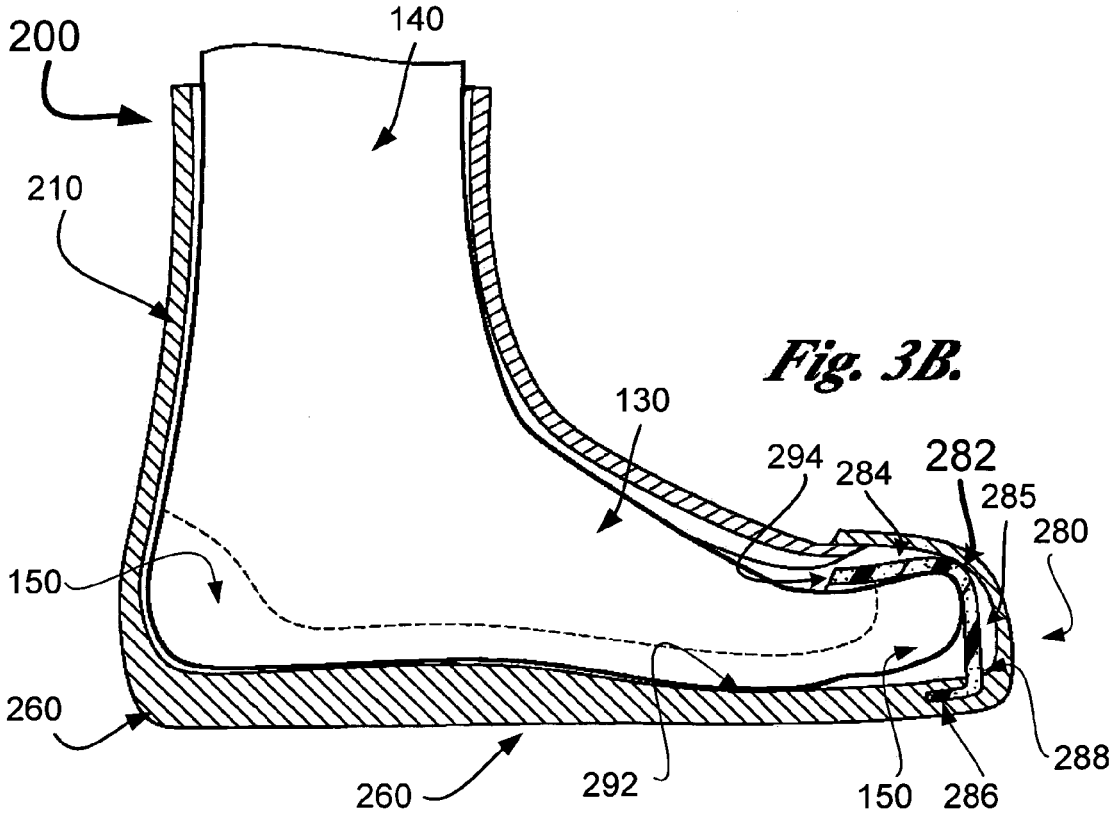
FIG. 3B is a side cutaway view of footwear including the toe engaging apparatus, the footwear being worn by a user with the user's toes in a raised position.

FIGS. 3A and 3B are additional side cutaway views of the footwear item 200 including the toe engaging apparatus 282 being worn on a foot 130 and ankle 140 of a wearer. More specifically, FIG. 3A depicts a position of the toe engaging apparatus when the toes 150 are in a lowered position. On the other hand, FIG. 3B, depicts a position of the toe engaging apparatus when the toes 150 are in a raised position lifted above an interior surface of the sole 260 of the footwear item 200.

As shown in FIG. 3A, when the toes 150 are in a lowered position, the panel 284, secured by the attachment mechanisms 286, lightly engages at least one of an upper or front surface of at least one of the wearer's toes 150. By contrast with FIG. 2, in FIG. 3A it can be appreciated that the panel 284 is slightly deformed in the direction of the toebox 280 as compared with an undeformed position of the panel 284 in FIG. 2.

However, as shown in FIG. 3B, when the toes 150 are in a raised or extended position, the panel 284 is deformed upwardly into the toebox 280. As previously described, in one presently preferred embodiment, the panel 284 includes at least one of a flexible or a stretchable material. Also, the panel 284 is coupled with an interior of the footwear item 200 at a lower edge 288 of the panel 284 or side edges of the panel 284 (not shown in FIG. 3B), but the panel 284 is not coupled with the top edge 294 of the panel 284. Thus, the panel 284 is deformable and movable, thereby allowing the wearer to move his or her toes 150. Thus, as shown in FIGS. 3A and 3B, the panel 284 engages the toes 150 of the wearer whether the toes 150 are in a lowered position (FIG. 3A) or a raised position (FIG. 3B).

Disposing the panel 284 near and/or against the toes provides potential benefits. For example, contact between the panel 284 and the toes 150 provides sensory stimuli from the footwear 200 the wearer's toes 150, allowing for proprioception which allows the wearer to take advantage of the unconscious perception of movement and spatial orientation of the toes 150 relative to the footwear 200. Positioning of the panel 284 against the toes 150 effectively closes off open space within the toebox 280 to provide additional thermal insulation for the wearer.

At the same time, the wearer's toes 150 are removed from the toebox 280 of the footwear 200, protecting the wearer's toes 150 from impact injuries that may result from an object striking an outside surface of the toebox 280. Also, while the wearer's toes 150 contact the panel 284 movably disposed within the toebox 280, an open space 285 between the panel 284 and the toebox 280 provides for additionally breathability for the wearer's foot.

Embodiments of the present invention include the toe engaging apparatus 282 (FIGS. 2, 3A, and 3B), a footwear lining apparatus incorporating the toe engaging apparatus, and a footwear system incorporating the toe engaging apparatus 282. Embodiments of the present invention also include a method in which a suitable panel 284 is formed, placed, and secured within an interior of a footwear item to engage a wearer's toes.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A toe engaging apparatus for an interior of a footwear item, the apparatus comprising a panel configured to extend at least partially across an interior of a toebox of the interior of the footwear item, the panel being coupled directly to an interior of the footwear item such that the panel is positioned inside the toebox to continually engage an upper forward edge of at least one of the wearer's toes while the footwear is being worn by the user, said panel being spaced from a forward and upper portion of the toebox at a panel mid portion absent the wearer's toes forcing said portion into contact with the toebox.

2. The apparatus of claim 1, wherein the panel includes a flexible material.

3. The apparatus of claim 2, wherein the panel includes a stretchable material.

4. The apparatus of claim 2, wherein the panel includes neoprene.

5. The apparatus of claim 1, wherein the panel is coupled to the interior of the footwear item using a bonding mechanism.

6. The apparatus of claim 5, wherein the bonding mechanism includes at least one of stitching, adhesive bonding, and thermal welding.

7. The apparatus of claim 1, wherein the panel is coupled to the interior of the footwear item at a plurality of points along at least one of a lower edge of the panel and side edges of the panel.

8. The apparatus of claim 7, further comprising an insole disposed in the interior of the footwear item, wherein the panel is coupled to the insole.

9. The apparatus of claim 7, wherein the deformable panel is coupled to the interior of the footwear item so that at least a portion of an upper edge of the panel is moveable relative to the inside of the toebox.

10. A toe engaging apparatus for an interior of a footwear item, the apparatus comprising:

a panel configured to extend at least partially across an interior of a toebox of the interior of the footwear item; and an attachment mechanism configured to position the panel in the interior of the footwear item so that the panel is positioned inside the toebox to continually engage an upper forward edge of at least one of the wearer's toes, said panel being spaced from a portion of the toebox in front of the users toes at a panel mid portion absent the wearer's toes forcing said portion into contact with the toebox.

11. The apparatus of claim 10, wherein the panel includes a flexible material.

12. The apparatus of claim 11, wherein the panel includes a stretchable material.

13. The apparatus of claim 11, wherein the panel includes neoprene.

14. The apparatus of claim 10, wherein the attachment mechanism includes at least one of stitching, adhesive bonding, and thermal welding.

15. The apparatus of claim 10, wherein the attachment mechanism joins the panel to the interior of the footwear item at a plurality of points along at least one of a lower edge of the panel and side edges of the panel.

16. The apparatus of claim 15, further comprising an insole disposed in the interior of the footwear item, wherein the attachment mechanism joins the panel to the insole.

17. The apparatus of claim 15, wherein the attachment mechanism is configured to flexibly join the panel to the interior of the footwear item so that at least a portion of an upper edge of the panel is moveable relative to the inside of the toebox.

18. A footwear lining apparatus comprising:

a liner configured to line an interior of a footwear item such that an interior of the liner generally receives a foot of a wearer and an exterior of the liner engages an interior of the footwear item; and a panel configured to extend at least partially across a toebox of the liner, the panel being coupled to the interior of the liner such that the panel is positioned inside the toebox to continually engage an upper forward edge of at least one of the wearer's toes, said panel being spaced from the toebox at a panel mid portion in front of the users toes absent the wearer's toes forcing said portion into contact with the toebox.

19. The apparatus of claim 18, wherein the panel includes a flexible material.

20. The apparatus of claim 19, wherein the panel includes a stretchable material.

21. The apparatus of claim 19, wherein the panel includes neoprene.

22. The apparatus of claim 18, wherein the panel is coupled to the interior of the liner using a bonding mechanism.

23. The apparatus of claim 22, wherein the bonding mechanism includes at least one of stitching, adhesive bonding, and thermal welding.

24. The apparatus of claim 18, wherein the panel is coupled to the interior of the liner at a plurality of points along at least one of a lower edge of the panel and side edges of the panel.

25. The apparatus of claim 24, further comprising an insole disposed in the interior of the liner, wherein the panel is coupled to the insole.

26. The apparatus of claim 24, wherein the deformable panel is coupled to the interior of the liner such that at least a portion of an upper edge of the panel is moveable relative to the inside of the toebox.

27. A footwear system comprising:

an upper configured to receive a foot of a wearer, the upper being configured such that toes of the wearer can be at least partially moved without contacting an interior of the upper;

an outersole fixably mounted to the upper; and a panel configured to extend at least partially across an interior of a toebox of the upper, the panel being coupled to the interior of the upper such that the panel is positioned inside the toebox to continually engage an upper forward edge of at least one of the wearer's toes, said panel being spaced from the toebox at a panel mid portion behind an upper forward portion of the toebox absent the wearer's toes forcing said portion into contact with the toebox.

28. The system of claim 27, wherein the panel includes a flexible material.

29. The system of claim 28, wherein the panel includes a stretchable material.

30. The system of claim 28, wherein the panel includes neoprene.

31. The system of claim 27, wherein the panel is coupled to the interior of the upper using a bonding mechanism.

32. The system of claim 31, wherein the bonding mechanism includes at least one of stitching, adhesive bonding, and thermal welding.

33. The system of claim 27, wherein the panel is coupled to the interior of the upper at a plurality of points along at least one of a lower edge of the panel and side edges of the panel.

34. The system of claim 33, further comprising an insole disposed in the interior of the upper, wherein the panel is coupled to the insole.

35. The system of claim 33, wherein the deformable panel is coupled to the interior of the upper such that at least a portion of an upper edge of the panel is moveable relative to the inside of the toebox.

36. The system of claim 27, wherein the footwear system includes one of a skate or a ski boot.

37. A method for engaging toes of a wearer in an interior of a footwear item, the method comprising:

forming a panel configured to extend at least partially across a toebox interior of the footwear item;

positioning the panel at a location inside the toebox of the interior of the footwear item so that the panel is positioned inside the toebox to continually engage an upper forward edge of at least one of the wearer's toes, said panel being spaced from the toebox at a panel mid portion behind an upper forward portion of the toebox absent the wearer's toes forcing said portion into contact with the toebox; and securing the panel directly to the toebox.

38. The method of claim 37, further comprising forming the panel from a flexible material.

39. The method of claim 38, wherein the panel includes a stretchable material.

40. The method of claim 38, wherein the panel includes neoprene.

41. The method of claim 37, wherein the panel is secured at the location using at least one of stitching, adhesive bonding, and thermal welding.

42. The method of claim 41, further comprising securing the panel to the interior of the footwear item at a plurality of points along at least one of a lower edge of the panel and side edges of the panel.

43. The method of claim 42, further comprising providing an insole disposed in the interior of the footwear item and securing the panel to the insole.

44. The method of claim 42, further comprising flexibly joining the panel to the interior of the footwear item so that at least a portion of an upper edge of the panel is moveable relative to the inside of the toebox.

* * * * *